US005638341A

United States Patent [19]

Amano

[11] Patent Number: 5,638,341

[45] Date of Patent: Jun. 10, 1997

[54] WATCH CHARACTER PANEL AND WATCH

[75] Inventor: Kazuhiko Amano, Suwa, Japan

[73] Assignee: Seiko Epson Corporation, Tokyo, Japan

[21] Appl. No.: 374,553

[22] PCT Filed: May 20, 1994

[86] PCT No.: PCT/JP94/00818

§ 371 Date: Mar. 20, 1995

§ 102(e) Date: Mar. 20, 1995

[87] PCT Pub. No.: WO94/28468

PCT Pub. Date: Dec. 8, 1994

[30] Foreign Application Priority Data

May 21, 1993 [JP] Japan ..... 5-120236

[51] Int. Cl.[6] ..... G04B 19/00

[52] U.S. Cl. ..... 368/223; 368/233

[58] Field of Search ..... 368/223, 233

[56] References Cited

U.S. PATENT DOCUMENTS

| | | | |
|---|---|---|---|
| Re. 22,570 | 11/1944 | lux | 368/233 |
| 2,794,314 | 6/1957 | Slaugh | 368/233 |
| 3,156,990 | 11/1964 | Dock | 368/223 |
| 3,427,800 | 2/1969 | Blum | 368/223 |
| 3,777,475 | 12/1973 | Grossan | 368/233 |

FOREIGN PATENT DOCUMENTS

| | | |
|---|---|---|
| 0165381 | 12/1985 | European Pat. Off. . |
| 0307126 | 3/1989 | European Pat. Off. . |
| 0492027 | 7/1992 | European Pat. Off. . |
| 3600291 | 7/1987 | Germany . |
| 4038369 | 3/1992 | Germany . |
| 50-15578 | 2/1975 | Japan . |
| 0077675 | 7/1978 | Japan . |
| 54-115977 | 8/1979 | Japan . |
| 57-196182 | 12/1982 | Japan . |
| 58-108486 | 6/1983 | Japan . |
| 60-163391 | 10/1985 | Japan . |
| 615489 | 1/1986 | Japan . |
| 32592 | 1/1991 | Japan . |

*Primary Examiner*—Berard Roskoski
*Attorney, Agent, or Firm*—Mark P. Watson; Eric B. Janofsky

[57] ABSTRACT

From various traditional medical teachings, it is known that humans have a life rhythm which depends upon the time. As one example, there are the traditional Indian medical teachings of the "Ayurveda". In the present invention, in order to display which time period of the Ayurveda corresponds to the present time, a character panel of a watch has been separated according to color into three wedge-shaped regions. The respective color-separated regions correspond to the Vata (V), the Kapha (K), and the Pitta (P) of the Ayurveda. The Ayurveda time is indicated by an hour hand which points to one of these regions.

2 Claims, 12 Drawing Sheets

SUDDEN DEATH RATE

WATCH CHARACTER PANEL AND WATCH

BACKGROUND OF THE INVENTION

1. Technical Field of the Invention

The present invention relates to watches, more specifically to a character panel for watches having the capability to display information besides the time, such as life rhythms.

2. Background Art

From various traditional medical teachings, it is known that humans have a life rhythm which depends upon the time. As an example, according to the traditional Indian medical teachings of the "Ayurveda", assuming that sunrise occurs at 6 a.m. and sundown occurs at 6 p.m., the human life rhythm is as follows.

First, the time periods from 6 a.m.–10 a.m. and 6 p.m.–10 p.m. are the best times for thinking, and are called Kapha (K) referring to the quality of stability/peacefulness in the body. When exercising during these time periods it is best to exercise lightly, and everyday labor should be performed only lightly as well. In addition, it is not advisable to eat or drink during these time periods. Kapha (K) is symbolized by "green".

Second, the time periods from 10 a.m.–2 p.m. and 10 p.m.–2 a.m. are the time periods for digestion and change, and are called Pitta (P) referring to the quality of activity. That is, the daytime period is an appropriate time period for eating, and is suited to digestive/metabolic activity. During the nighttime period, the matter absorbed through digestion is converted into flesh, particularly that of the extremities. Pitta (P) is symbolized by "red".

Third, the time periods from 2 a.m.–6 a.m. and 2 p.m.–6 p.m. are the time periods for activity and exercise, and are called Vata (V) referring to the quality of freshness/lightness. That is, the daytime Vata (V) is suitable for moving the body including comparatively heavy exercise. Additionally, regarding the early morning Vata (V), such phenomena as the bringing about of a good awakening due to the quality of freshness/lightness are able to be seen. Furthermore, as states of slumber, there are REM sleep and non-REM sleep. REM sleep is a state of slumber which is accompanied by bodily activity such as movement of the eyeballs, and the fact that REM sleep becomes longer during the Vata (V) from 2 to 3 o'clock has been made clinically clear. The daily bodily quality, activity quality, and seasonal quality are described by the three qualities of the Vata (V), the Pitta (P), and the Kapha (K). Slumber is taken in the time period from 10 p.m. to 6 a.m., and in the time periods of the Pitta (P) and the Vata (V) the decay of the dosha which is the bodily balance is undone. For example, the changing of one's position during sleep may be seen as such a phenomenon.

The above division of time is given the name "Ayurveda time". The above example is for the case in which sunrise occurs at 6 a.m. and sundown occurs at 6 p.m., but generally, the Kapha (K), Pitta (P), and Vata (V) are determined by respectively splitting into three equal parts the time periods from sunrise to sundown and from sundown to sunrise. Furthermore, the "time" referred to here is not the standard time, but rather the time for the case in which noon is taken as the time at which the sun lies directly south of the region in which the relevant person is living. Thus, Ayurveda time changes with respect to the location, the season, and day and night.

Besides the Ayurveda, there have been many reports on the life rhythms of humans. For example, in the stress-filled present, sudden death has been a popular topic of conversation, but it has been reported that the chances for the occurrence of sudden death fluctuate cyclically taking one day as a single cycle, and that there are respective time periods for which the probability of death is low and high.

It is believed that if everyone could have easy access to knowledge of the Ayurveda time and information regarding other human life rhythms, it would help people to take actions appropriate to their life rhythms. However, up until now, there have not been any simple means suitable to the required meaning.

SUMMARY OF THE INVENTION

The present invention takes account of the above circumstances, and has as an objective the presentation of a watch and a character panel for a watch which can automatically display life rhythms.

A watch according to the present invention comprises a display means for displaying time and life rhythm of a living body which changes during a day and a control means for dividing changes in the life rhythm during the day according to fixed time periods and for controlling the display means to display the life rhythm at present time. The life rhythm indicates a condition of the living body.

According to the present invention, the display means preferably includes watch hands for displaying the time, a watch hand movement means for moving the watch hands, and a character panel for a watch. The character panel for a watch according to the present invention features a plurality of display regions each of which stretch outward from the center of the watch face and are arranged in the direction of rotation of the watch hands, and a multiple color display section for dividing each of the display regions by color.

Additionally, the watch according to the present invention is provided with a character panel having a plurality of display regions each of which stretch outward from the center of the watch face and are arranged in the direction of rotation of the watch hands, and a multiple color display section for dividing each of the display regions by color; and a control means which displays the plurality of sectors which represent the respective divisions of the daily rhythm which change daily by separating them by color onto the multiple color display section of the character panel.

With the use of the present invention, the current division of the daily rhythm is able to be easily determined from the hands and the display panel.

Other objects and attainments together with a fuller understanding of the invention will become apparent and appreciated by referring to the following description and claims taken in conjunction with the accompanying drawings.

DESCRIPTION OF THE PREFERRED EMBODIMENTS

First Embodiment

Figure 1:
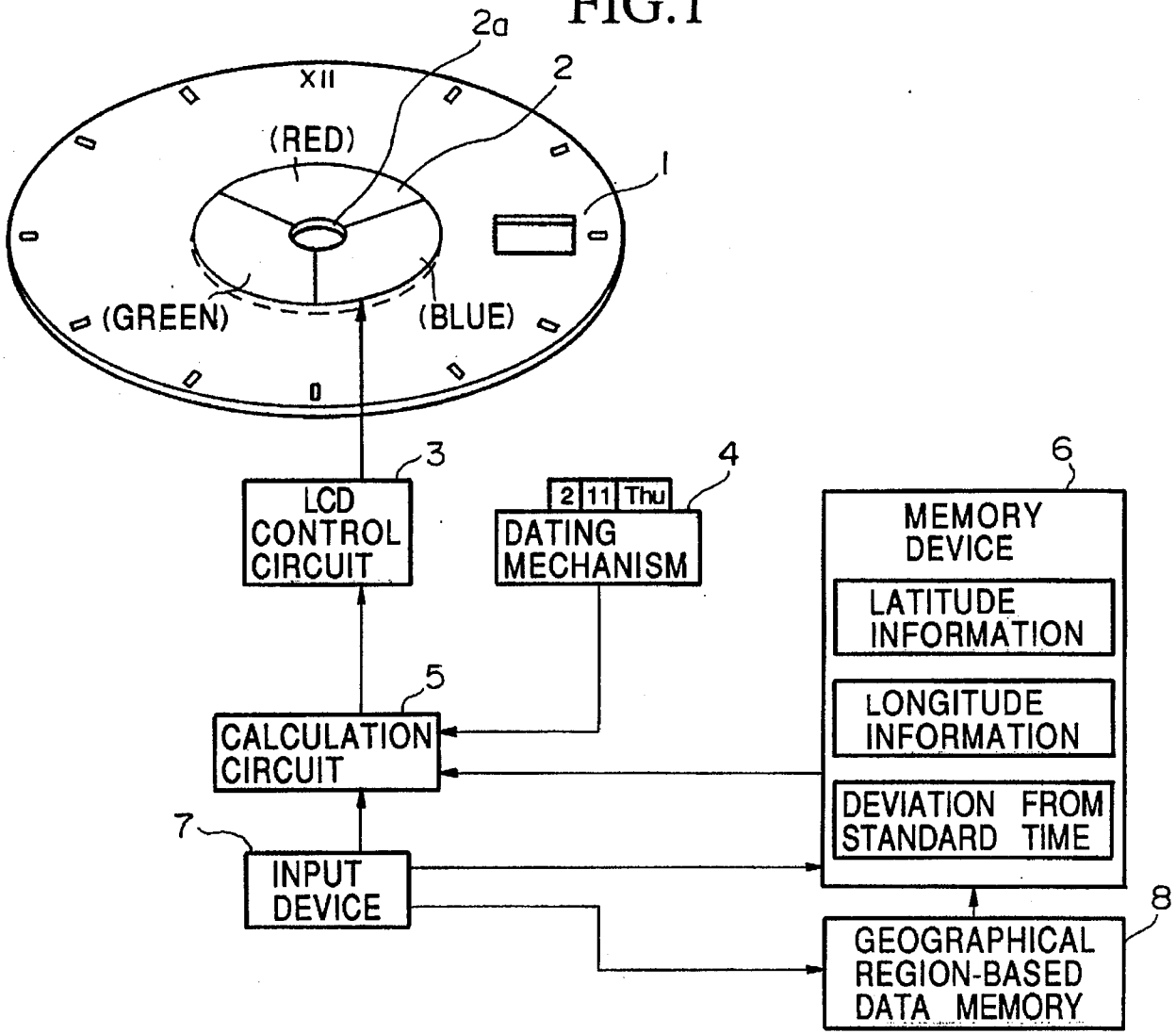
FIG. 1 is a block diagram of the first embodiment of the present invention.

The wristwatch of the first embodiment of the present invention will be explained with reference to FIG. 1.

In the figure, 1 is a character panel for a wristwatch, provided with a circular color LCD display device 2 in its central portion. The LCD display device 2 is able to, according to the control of the LCD control circuit 3, generate light of the appropriate color red, green, or blue, and to separate the colors with borders formed in the radial direction. A watch hand axis is passed through the hole 2 of the LCD display device 2, and it moves the hands (not shown) which are provided above the character panel 1.

Next, 6 is a memory device which stores latitude information indicating the latitude, longitude information indicating the longitude, and the deviation from standard time. Here, the deviation from standard time is information indicating the difference between the noon of standard time and the time at which the is actually positioned directly south. Additionally, 4 is a date mechanism which outputs information on the date.

5 is a calculation circuit, and when the above-mentioned date information, latitude information, longitude information, and deviation from standard time are supplied, it calculates the times for sunrise and sundown based on these, and then calculates the Kapha (K), the Pitta (P), and the Vata (V) by respectively dividing into three equal parts the time period from sunrise to sundown (hereinafter referred to as daytime), and the time period from sundown to sunrise (hereinafter referred to as nighttime). Then, the calculation circuit 5, as appropriate to the present time, delivers a control signal to the LCD control circuit 3 so that a a display as explained below may be given by the LCD display device 2.

That is, if the present time is within the boundary from the first set rime (such as midnight) to the second set time (such as noon), then a control signal, such that the positions which correspond to the daytime Kapha (K), Pitta (P), and Vata (V) turn respectively green, red, and blue, is sent from the calculation circuit 5 to the LCD control circuit 3. On the other hand, if the present time is within the boundary from the second set time to the first set time, then a control signal, such that the positions which correspond to the nighttime Kapha (K), Pitta (P), and Vata (V) turn respectively green, red, and blue, is sent from the calculation circuit 5 to the LCD control circuit 3.

Next, 7 is an input device, through which the latitude information, the longitude information, and the deviation from standard time are entered and written into the memory device 6. Additionally, when the first and second set times are entered through the input device 7, they are then sent to the calculation circuit 5. 8 is a region-based data memory, in which are stored the names of various geographical regions and their corresponding latitude information, longitude information, and deviation from standard time. In this case, the region names stored in region-based data memory 8 may be, for example, the names of the Japanese prefectures, and the names of major Japanese and world cities.

The input device 7 is able to set a certain regional name stored in the region-based data memory 8, and when such a regional name is set, the latitude information, longitude information, and deviation from standard time corresponding to the region are sent from the region-based data memory to the memory device 6.

Concerning the above composition, when such information as the latitude information are directly entered into the input device 7, the entered data are stored in the memory device 6. Alternatively, when the region is set by the input device 7, the information which corresponds to that region is sent from the region-based data memory 8 to the memory device 6. Furthermore, in the standard set state, the first set time is noon and the second set time is midnight, but if the user changes these, the information is stored in the calculation circuit 5.

Then, when the information stored in the memory device 6 and the date information output from the date mechanism 4 is delivered to the calculation circuit 5, the display face of the LCD display device 2 is divided into three colors. As a result, the user can easily tell the Ayurveda time by simply determining by eye in which of the three color-separated regions the short hand of the watch (not shown) is.

In the case in which the watch is to be used within a set geographical area, the latitude and longitude information in the memory device 6 may be set at constant values.

Second Embodiment

Figure 2:
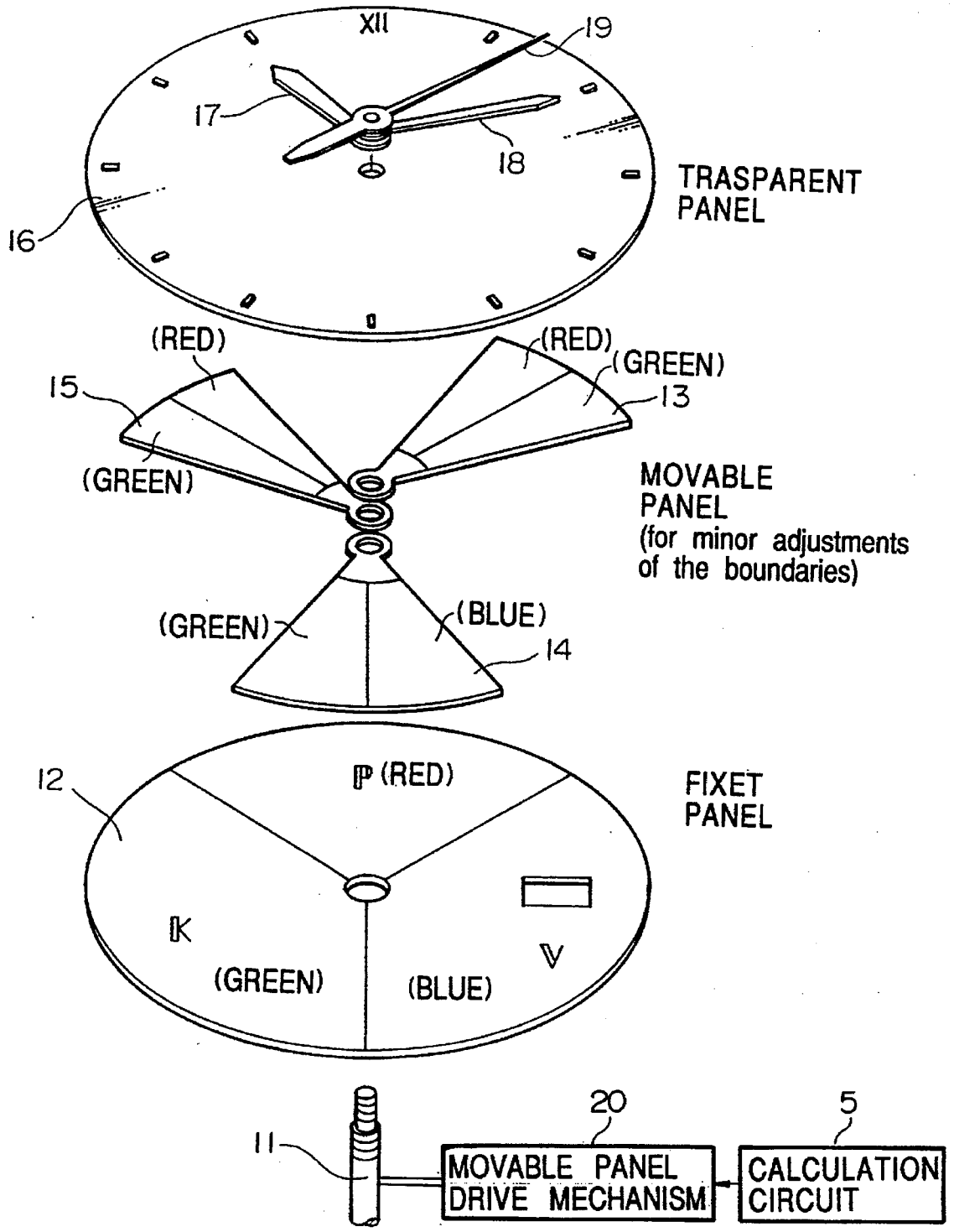
FIG. 2 is an exploded view of the principal parts of the second embodiment.

The second embodiment of the present invention will be explained with reference to FIG. 2.

In the figure, 11 is a coaxial watch hand axis which passes through, in order, the fixed panel 12, the movable panels 13, 14, and 15, the transparent panel 16, the short hand 17, the long hand 18, and the second hand 19. In this case, the fixed panel 12 and the transparent panel 16 are fixed to the body of the wrist watch (not shown), and the movable panels 13, 14, and 15, the short hand 17, the long hand 18, and the second hand 19 move due to the rotation of the various parts of the axis 11.

Furthermore, the wrist watch of the present embodiment, identical to the first embodiment, is provided with the respective compositional elements 4–8 shown in FIG. 1, but instead of the LCD circuit 3, it is provided with the movable panel activation mechanism 20 which moves the movable panels 13, 14, and 15 through the axis 11.

The fixed panel 12 is made by dividing a circular panel into three equal sections in a circumferential direction and painting these red, blue, and green, and the movable panels 13, 14, and 15 are positioned above the boundary lines. The movable panels 13, 14, and 15 are thin panels designed in an approximate wedge shape, and they are divided by paint, with the center line as the boundary line, into red and blue, blue and green, and green and red.

Then, the movable panels 13, 14, and 15, due to the calculation circuit 5 and the movable panel activation mechanism 20, are controlled so that the center lines of these movable panels are each positioned at the boundary times between the Vata (V), the Kapha (K), and the Pitta (P).

According to the above composition, when the fixed panel 12 and others are seen through the transparent panel 16, due to the movement of the movable panels 13, 14, and 15, the positions of the boundaries between the colors changes. That is, as with the first embodiment, it is possible to easily know the Ayurveda time from the position of the short hand 17.

Modification Examples

Of course, various modifications on the above-described first and second embodiments are possible, such as the ones given below.

(1) The LCD display device 2 of the embodiments does not have to be divided into three colors, and it can display entirely the one color (red, blue, or green) which symbolizes the Ayurveda time corresponding to the present time.

In this case, it is possible to locate the LCD display device 2 somewhere besides the central portion of the character panel.

(2) In the embodiments, it is possible to compose the character panel 1 entirely of an LCD display device.

(3) When applying this invention to a digital watch, two-layer liquid crystal may be used. That is, by displaying the time in black by the first layer of the liquid crystal and displaying the color symbolizing the Ayurveda time by the second layer, it is possible to display the Ayurveda time as the background color of the characters.

Third Embodiment

Although the Ayurveda time was displayed in the first and second embodiments given above, the displayable life rhythms are obviously not limited to the Ayurveda time an embodiment of the present invention which displays something other than the Ayurveda time will be explained below.

Figure 3:
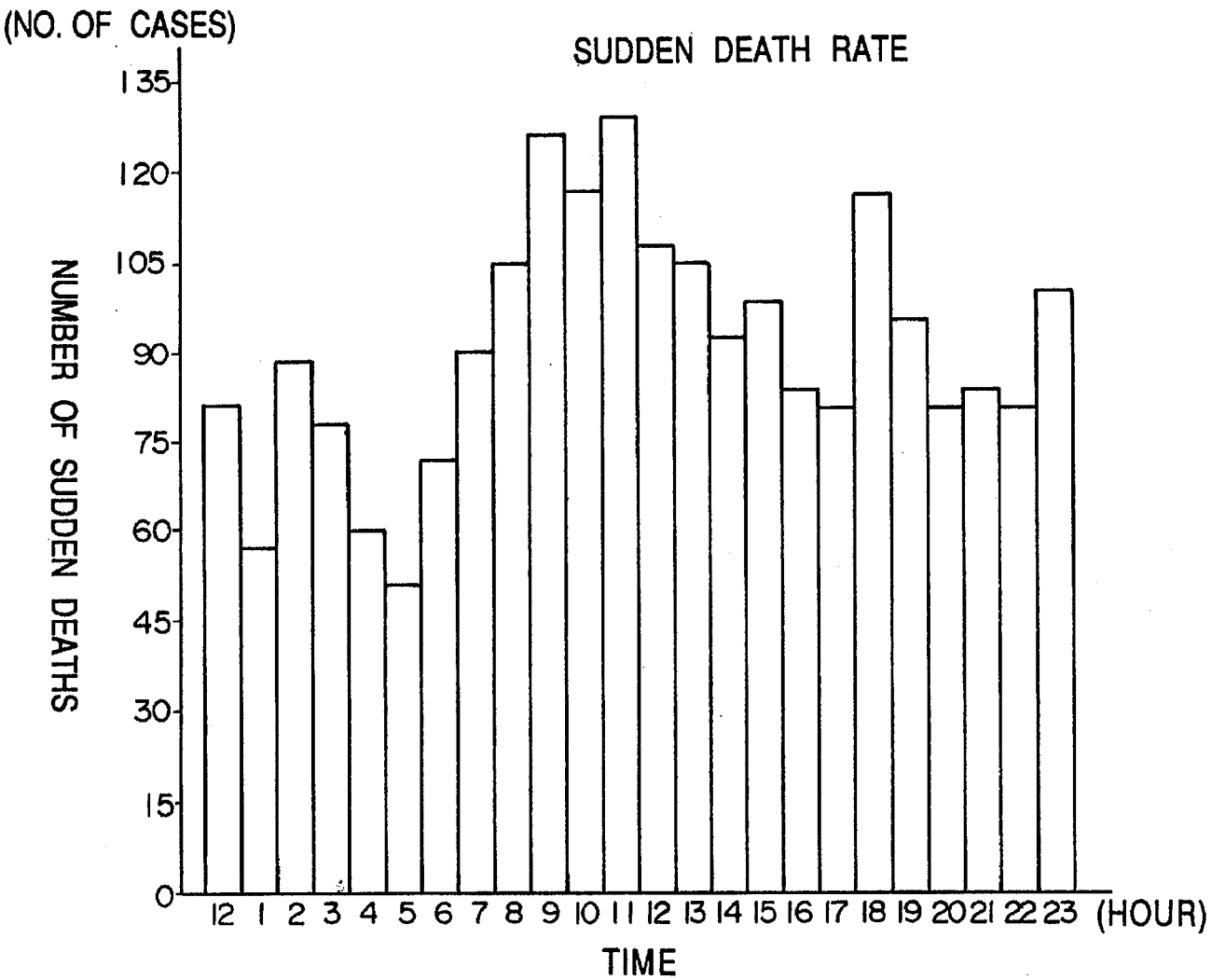
FIG. 3 is a graph showing the daily variation in the number of occurrences of sudden death.
Figure 4:
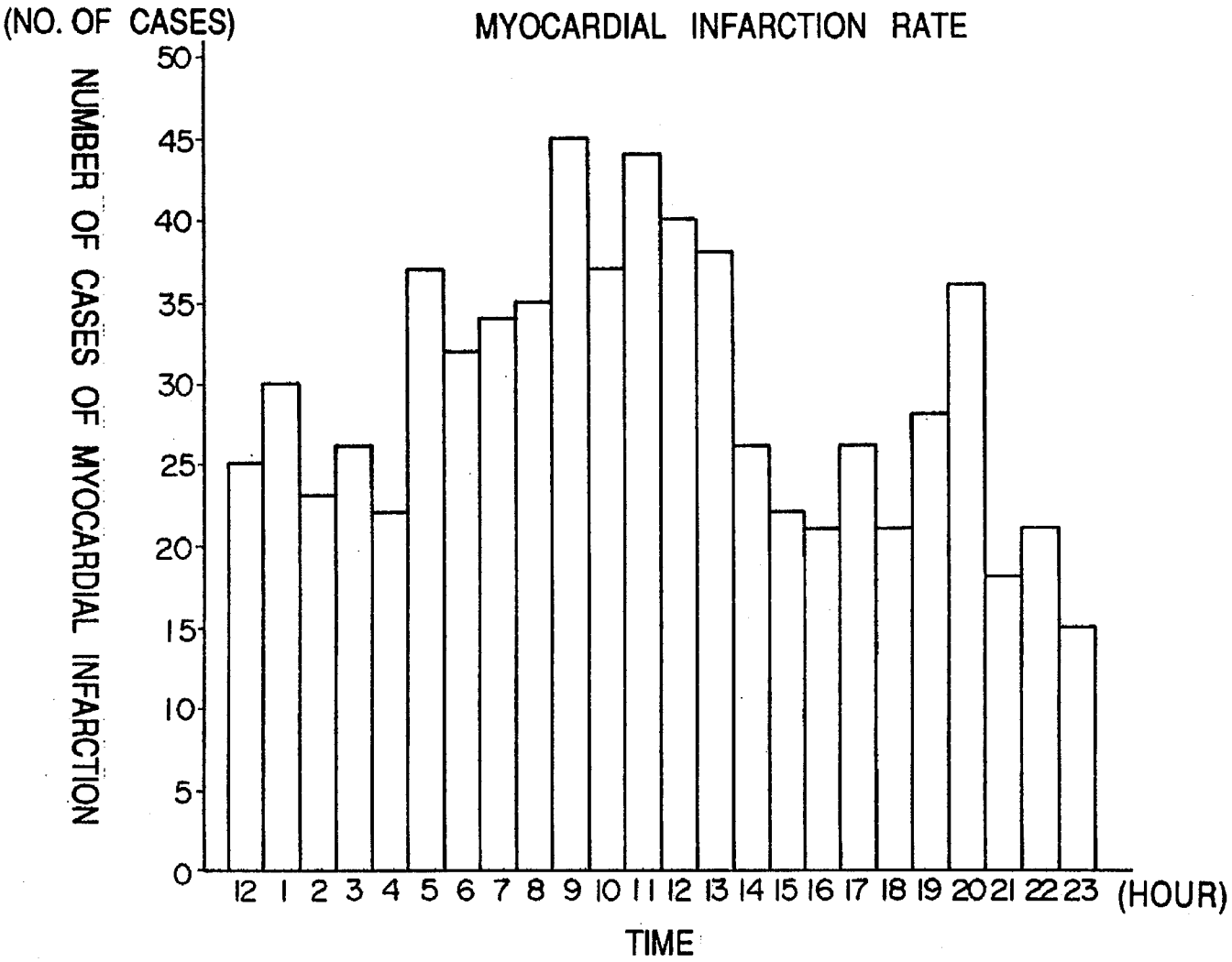
FIG. 4 is a graph showing the daily variation in the number of occurrences of myocardial infarction.

Recently, sudden death has become a popular topic of conversation, but the probability of occurrence of sudden death fluctuates cyclically when taking a single day as one cycle, and it is know that there are time periods for which the chances for death are respectively low and high. FIG. 3 shows the daily variation in the occurrence of sudden death. Additionally, FIG. 4 shows the daily variation in the occurrence of myocardial infarctions. This data has been published in *Muller JE, et. al., Circulation,* 79: 733–734, 1989.

Furthermore, the inventors of the present invention, as a result of a series of experimental activities, have been able to determine that the circulatory activity state parameters which represent the conditions of the circulatory system fluctuate cyclically with a single day as one cycle. Below, the daily variations in the circulatory system determined by the present inventors is explained.

Figure 5:
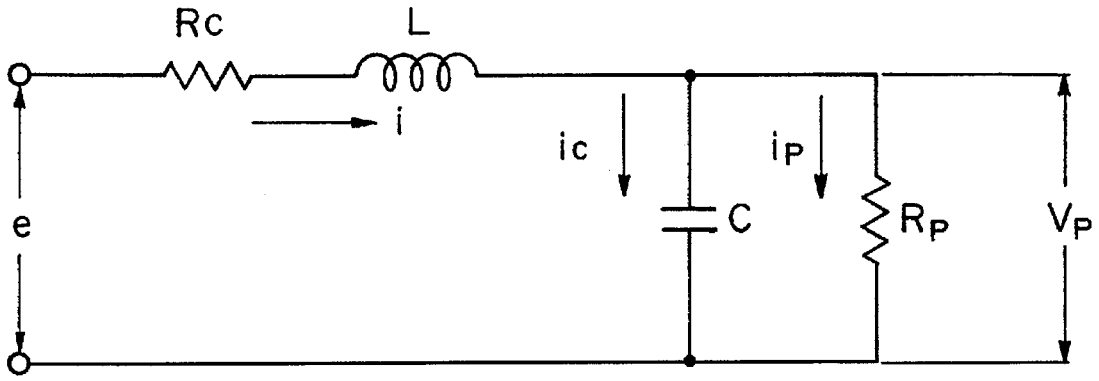
FIG. 5 is a circuit diagram showing the Four Element Concentration Constant Model.

First, the present inventors hypothesized that the circulatory activity state parameters compose the Four Element Concentration Constant Model shown in FIG. 5, and decided to determine what kind of time-related changes occurred in the respective elements of the Four Element Concentration Constant Model. This Four Element Concentration Constant Model, out of the circulatory activity state parameters which determine the activity of the circulatory system of the human body, observes the four parameters given by the inertia of the blood in the central portion of the arterial system, the blood vessel resistance due to the blood viscosity in the central portion (viscous resistance), the compliance of the blood vessels in the central portion (viscoelasticity), and the blood vessel resistance in the extremities (viscous resistance), and models them on an electrical circuit. The relationship between the above-given parameters and the respective elements composing the Four Element Concentration Constant Model are shown below.

Inductance L: blood inertia in the central portion of the arterial system [dyn-s$^2$/cm$^5$]

Capacitance C: blood vessel compliance in the central portion of the arterial system [cm$^5$/dyn]

In this case, compliance is an amount representing the flexibility of a blood vessel, and it refers to the viscoelasticity.

Resistance $R_c$: blood vessel resistance due to the blood viscosity in the central portion of the arterial system [dyn.s/cm$^5$]

Resistance $R_p$: blood vessel resistance due to blood viscosity in the extremities of the arterial system [dyn. s/cm$^5$]

Furthermore, the electric currents i, $i_p$, and $i_c$ flowing through the various sections of the electric circuit correspond to the blood flow [cm$^2$/s] in the corresponding sections. Also, the input voltage e supplied to the electric circuit corresponds to the pressure [dyn/cm$^2$] of the aortal origin. Additionally, the voltage $v_p$ across the capacitance C corresponds to the pressure [dyn/cm$^2$] at the radial artery.

Figure 6:
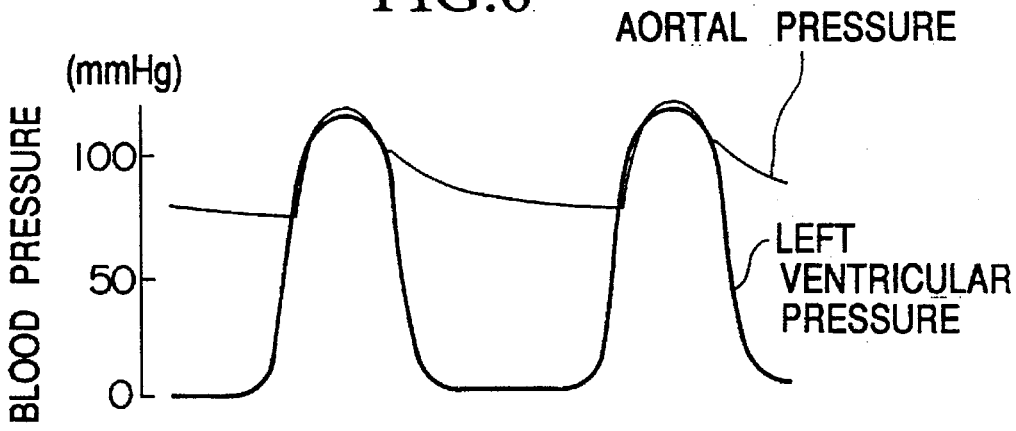
FIG. 6 is a graph showing the blood pressure waveform at the aortal origin.
Figure 7:
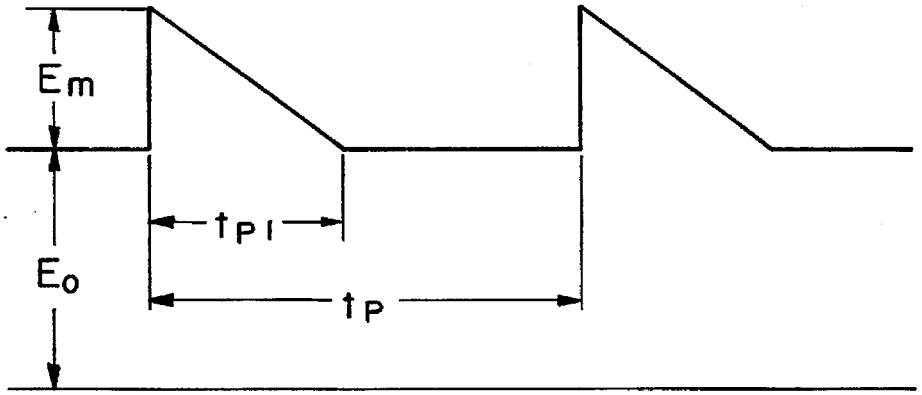
FIG. 7 is a graph showing the hypothetical blood pressure waveform at the aortal origin for determining the Four Element Concentration Constant Model.
Figure 8:
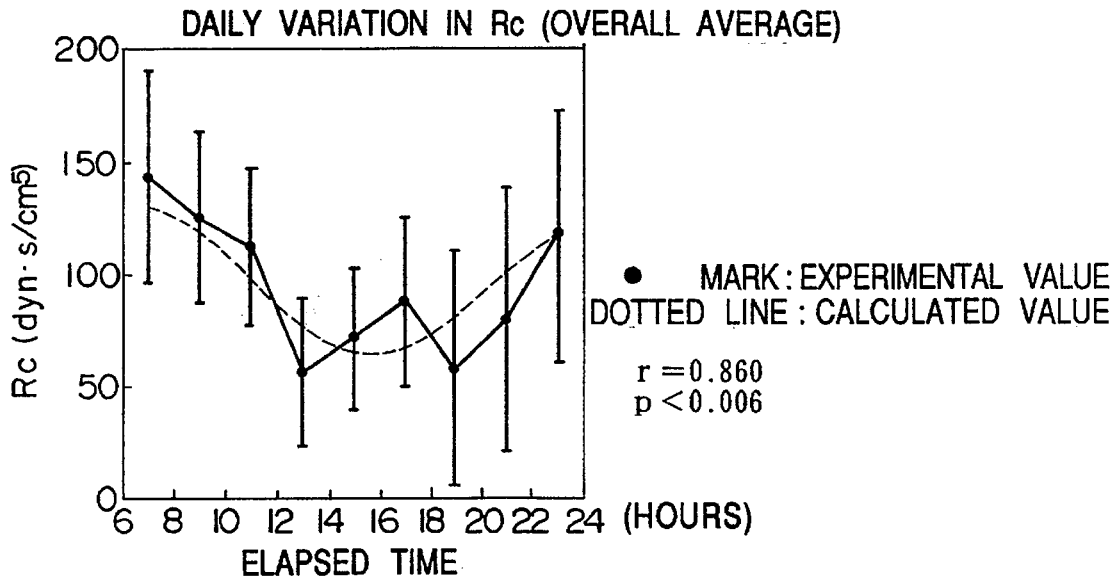
FIGS. 8–11 are graphs showing the daily variations of the circulatory system parameters.
Figure 9:
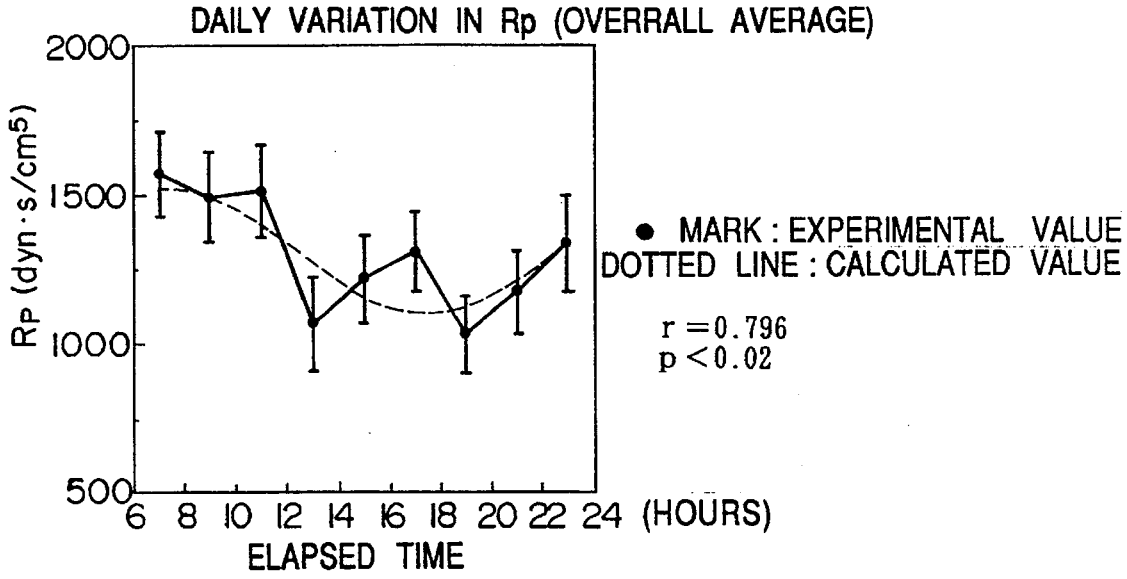
Figure 10:
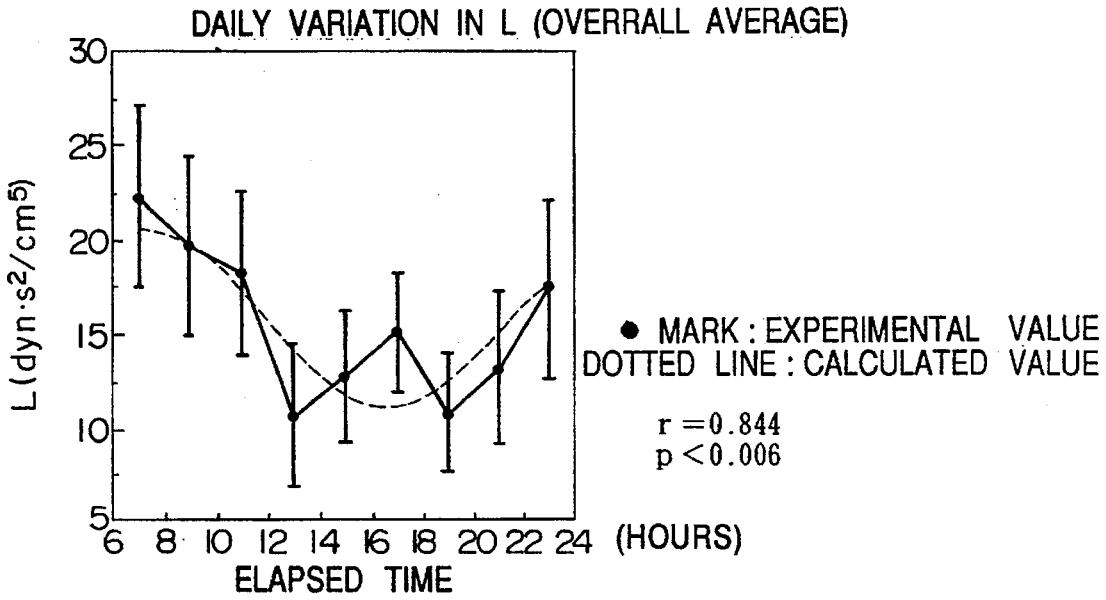
Figure 11:
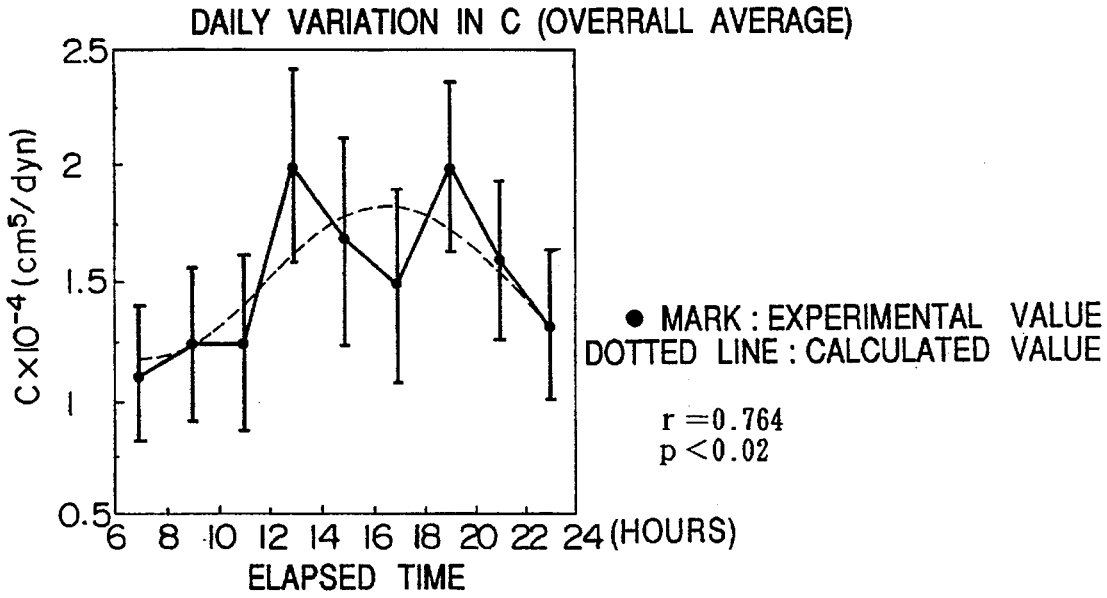

Furthermore, although the pressure waveform at the aortal origin is generally as shown in FIG. 6, such a pressure waveform may be approximated by a triangular waveform as shown in FIG. 7. In FIG. 7, $E_o$ is the minimum blood pressure (diastolic pressure), $E_o+E_m$ is the maximum blood pressure (systolic pressure), $t_p$ is the time required for a single beat, and $t_{p1}$ is the time from the rising of the aortal pressure to when the pressure reaches its minimum value.

Then, the present inventors measured the radial pulse wave and the output amount for one beat from 13 male subjects with normal blood pressure every two hours, and determined the circulatory activity parameters corresponding to the each radial pulse waveform, that is, they determined the values of each of the four elements L, C, $R_c$, and $R_p$ of the Four Element Concentration Constant Model needed to obtain a waveform on both sides of the capacitance C which is identical to the radial pulse wave when a triangular wave as shown in FIG. 7 is applied to the Four Element Concentration Constant Model. Methods for mathematically determining the values of the respective elements L, C, $R_c$, and $R_p$ of the Four Element Concentration Constant Model from the radial pulse waveforms and the output amount for one beat are described in Patent Application No. Heisei 5-1431 previously filed by the present applicant.

FIGS. 8–11 show the daily variation in the respective elements L, C, $R_c$, and $R_p$ determined in this manner, and in each graph is shown the average value of the L, C, $R_c$, and $R_p$ values of the 13 subjects and the range of dispersion (standard deviation). Additionally, in each graph, the dotted lines represent the basic waveform obtained by performing a rhythm analysis on the changes in the L, C, $R_c$, and $R_p$ values. From these graphs, it is known that the circulatory activity parameters of the human body change according to cyclic waveforms which have a single day as one cycle.

Such things as the daily variation in the occurrence of sudden death and the daily variation in the circulatory activity parameters of the human body explained above are, together with the above-described Ayurveda time, are life rhythms according to which all humans must live. If it is possible to know the time periods in which sudden deaths are most likely to occur and the rime periods in which the circulatory activity parameters are most likely to be at undesirable values, then it would be possible to take care not to overwork during such rime periods.

In the present embodiment, the daily variation in the number of occurrences of sudden death ia treated as a life rhythm, and is displayed in a watch character panel.

For example, the following are ways to display the occurrence rate of sudden death in a watch character display.

(1) The sudden death occurrence rates in FIG. 3 are divided into three levels such as high, medium, and low. Then, as in the first embodiment (FIG. 1), danger level information showing whether the sudden death occurrence rate is high, medium, or low for each time period is pre-stored in the memory device 6.

(2) The calculation section 5 reads from the above-mentioned memory device 6 the danger level information corresponding to the rime periods of the first half of the day if the present rime is from midnight to noon, and the danger level information corresponding to the time periods of the second half of the day if the present time is noon to midnight, and determines the display color of the respective time periods based on these. For example, letting the display color of time periods in which the sudden death occurrence rate is low be blue, that of time periods in which the sudden death occurrence rate is medium be green, and that of time periods in which the sudden death occurrence rate is high be red.

(3) Then, the calculation circuit 5 sends a control signal to the LCD control circuit 3 so that the regions corresponding to the various time periods in the LCD display device 2 are displayed in the display colors determined above. As a result of this type of control, the respective time periods for which the sudden death occurrence rate is low, medium, and high may be displayed according to color on the LCD display section 2 of the watch character panel 1.

Fourth Embodiment

The use of world watches, that is watches which, when the name of a major region of the world is given, display the time in that region, is known. The present embodiment is not the type which uses a bezel ring in order to allow for changing between regions, but the application of the present invention is an example in which a world watch changes the position of an indicator hand to correspond to the positions of the regions.

The basic composition is similar to the one for the first embodiment, so the present embodiment will be explained with reference to FIG. 1.

In the present embodiment, when the user sets the region on the watch display, the position of the indicator hand moves to the position corresponding to the set region. Then, the latitude information, longitude information, and deviation from standard time of the set region is read from the region-based data memory 8, and stored in the memory device 6.

Then, the latitude information, longitude information, and deviation from standard time in the memory device 6 are referred by the calculation circuit 5, and a display identical to the Ayurveda time of the above first embodiment is made.

Fifth Embodiment

Now suppose that a long distance move is made due to an aircraft or other such for of transportation.

(1) Then, such phenomena as, for example, when a person takes over four hours to go from country A to country B, the Ayurveda time of the moving person was already Kapha but the Ayurveda time in country B is still Vata, or (2) when a person goes from country A to country C in a short amount of time, the Ayurveda time of the moving person was still Vata but the Ayurveda time in country C is already Kapha, may occur.

Such phenomena in which one's life rhythm cannot adjust to a change in the time period are known generally as jet lag.

The world watch described in the above-mentioned fourth embodiment may also become easier to use if consideration is made of jet lag. That is, since time is needed in order for a user of a world watch to adjust to the Ayurveda time at his destination, the present embodiment makes use of display control of Ayurveda time which takes such an adjustment into consideration. The specifics are as follows.

First, in addition to the respective areas for storing the latitude information, longitude information, and deviation from standard time explained in the first embodiment, a preservation area is prepared in the memory device 6 for storing more latitude information, longitude information and deviation from standard time. Then, when a region is set, after storing the latitude information, longitude information, and deviation from standard time of the new region, the previously stored latitude information, longitude information, and deviation from standard time are sent to the preservation area.

The calculation circuit 5 first determines the boundary lines for displaying by color the Ayurveda time corresponding to the latitude information, longitude information, and deviation from standard time inside the preservation area (hereinafter referred to as the first boundary lines), then calculates the boundary lines for displaying by color the Ayurveda time corresponding to the new latitude information, longitude information, and deviation from standard time (hereinafter referred to as the second boundary lines), and at first, a control signal is sent to the LCD control circuit 3 such that a color-separated display of the Ayurveda time according to the first boundary lines is made.

Then, after a set time interval the first boundary lines are rotated by a certain angle, so that the boundary lines of the color-separated display of the Ayurveda time approach the above-mentioned second boundary lines little by little.

By doing this, a color-separated display of the Ayurveda time which accounts for the time needed for the life rhythm of the moving person to adjust to the Ayurveda time of his destination is had.

There are cases in which a region is chosen simply because one wishes to know the present time in a different region, in such a case, the movement of the color-separating boundary lines becomes extremely inconvenient. Therefore, in the present embodiment, after changing the present set region to another region, if the set region is returned to the original region within a set time interval, then the above procedure in which, "after a set time interval the first boundary lines are rotated by a certain angle, so that the boundary lines of the color-separated display of the Ayurveda time approach the above-mentioned second boundary lines little by little" is not carried out.

Sixth Embodiment

Figure 12:
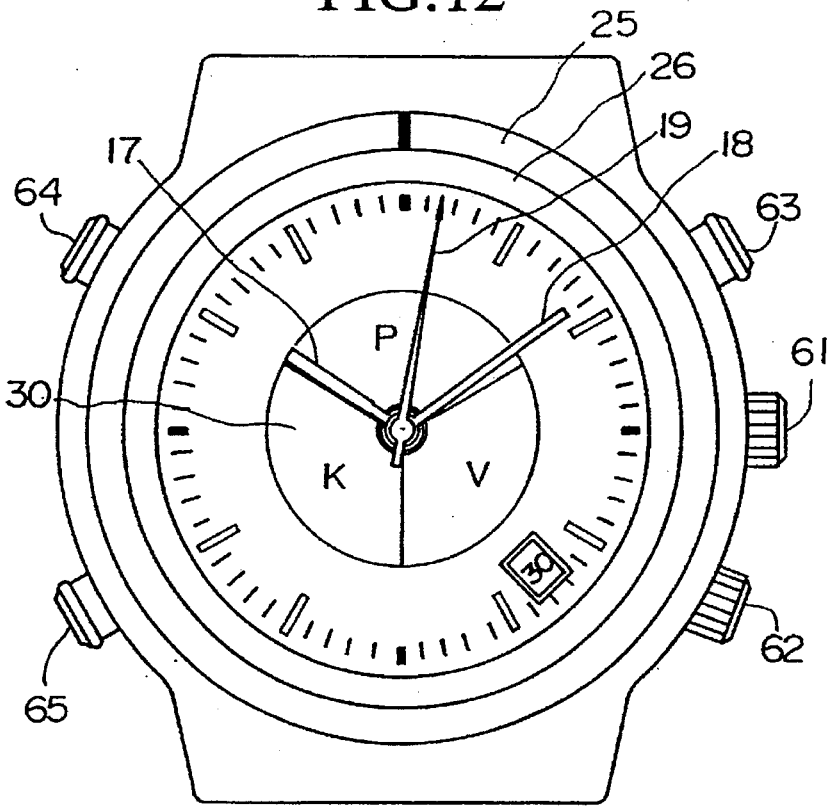
FIGS. 12 and 13 show the sixth embodiment of the present invention.

An outside view of the present embodiment is shown in FIG. 12.

In the central portion of the watch body, an hour hand 17, minute hand 18, and second hand 19 are provided so as to be able to turn about the same axis. In addition, a character panel 30 for Ayurveda time display is attached to the same axis. Furthermore, around the circumference of the watch face is provided a movable bezel ring 25, the inside portion to which is attached a ring 26 on which is displayed the names of major cities. The bezel ring 25 is provided with an encoder (not shown), which is able to measure its rotation angle. 61 and 62 are crowns, 63 and 64 are push-buttons.

Figure 14:
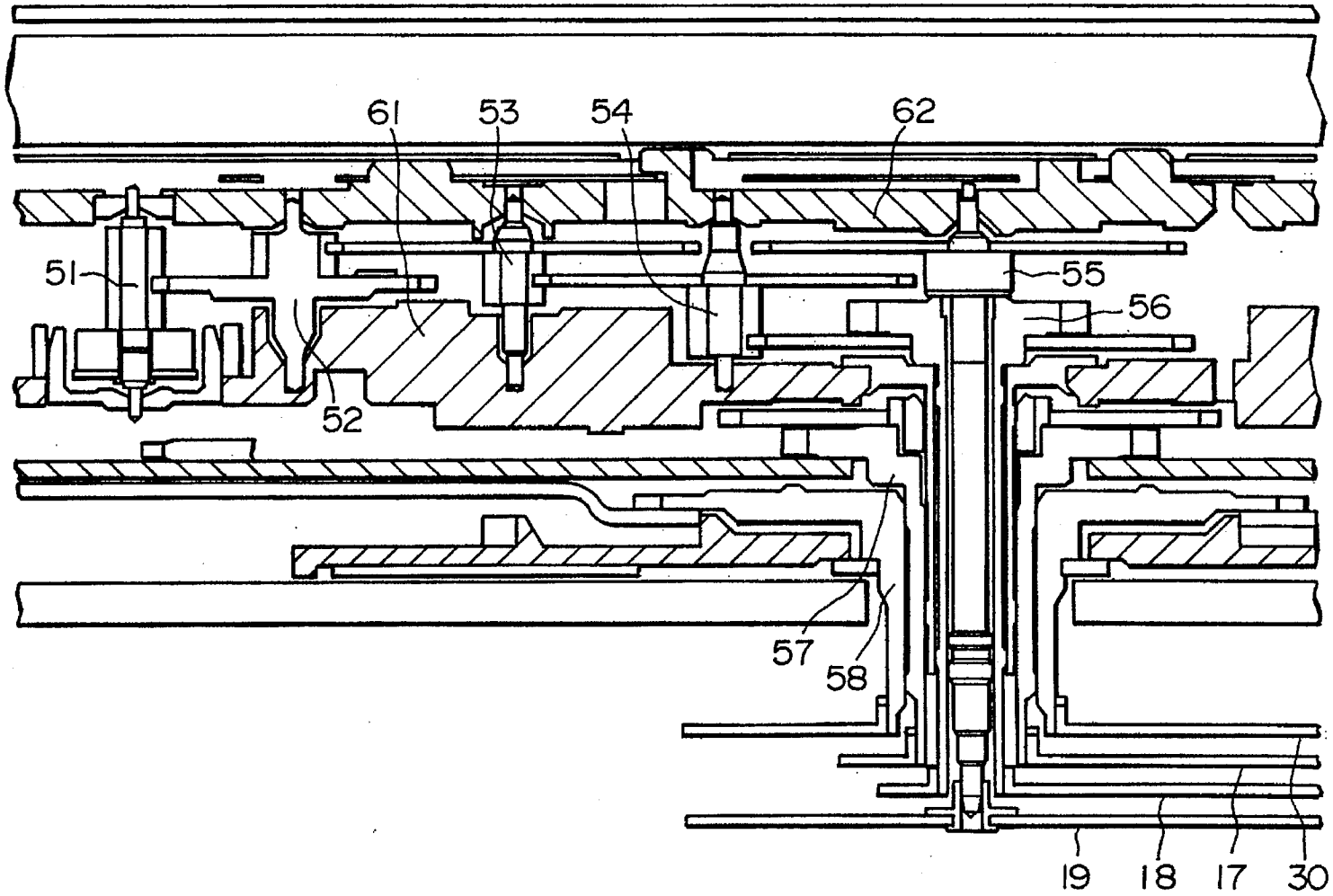
FIG. 14 is a cross-sectional view of the same embodiment.
Figure 15:
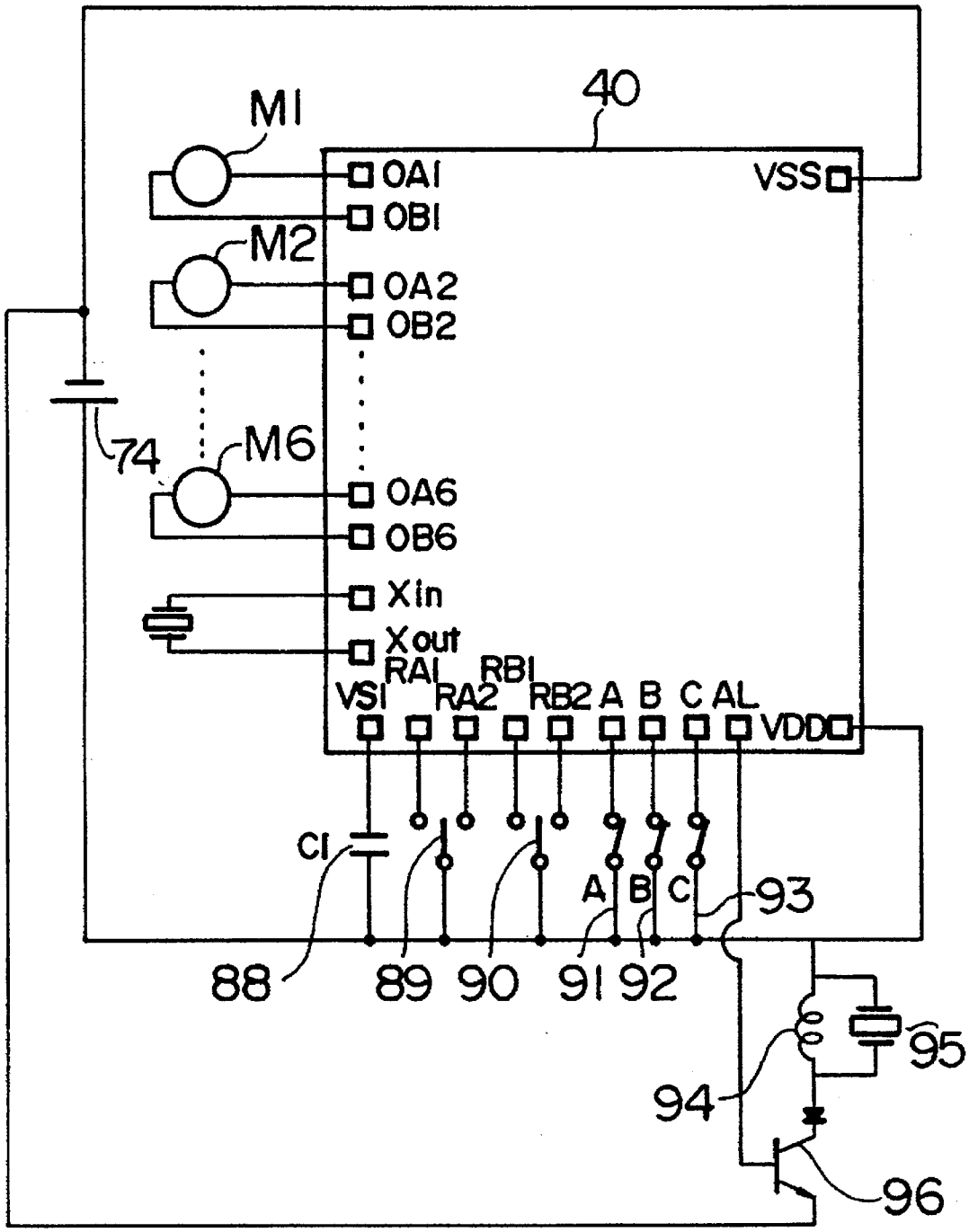
FIG. 15 is a circuit wiring diagram of the same embodiment.

The composition of the motion systems of the various needles is shown in FIG. 14. In FIG. 14, 51 is a rotor which is driven by a step motor with forward and reverse rotation capabilities. The rotation of this rotor 51 is transmitted to the second gear 55 through the third gear 54, the fourth gear 53, and the fifth gear 52, and it rotates the second hand 19 which is attached to the second gear. Additionally, cylindrical gears 56, 57, and 58 are attached to the minute hand 18, the hour hand 17, and the Ayurveda display panel 30 respectively. This Ayurveda display panel 30 is three wedge-shaped sections having a central angle of 120 degrees as shown in FIG. 12, and each section is given a color corresponding to P, V, or K. In the normal state in which a geographical region is not set, the P-V boundary line, the V-K boundary line, and the K-P boundary line point respectively to 2 o'clock, 6 o'clock, and 10 o'clock. Cylindrical gears 56 and 57 is attached to the gear sequence of the second hand system through another gear sequence not shown, and they turn the minute hand 18 and the hour hand 17. Rotational motion is transmitted from a step motor not shown in the drawing to the cylindrical gear 58. Also, 61 is a base board, and 62 is a gear sequence receiver.

FIG. 5 shows a circuit diagram of the present embodiment. In the diagram, 40 is the CPU-IC, a microcomputer for analog electrical watches which integrates such elements as a core CPU, a program memory, a motor driver, and a motor drive control circuit into a single chip. 74 is a lithium battery, and M1 through M6 are coil blocks for the step motor. The CPU-IC 40 activates each motor through such mechanisms as a motor drive, and rotates the hands 17 and 18, and the character panel 30 of FIG. 12. 87 is the tuning fork-shaped quartz oscillator inside of the CPU-IC 40 which serves as the oscillation source for the oscillator circuit, and 88 is a 0.1 μF capacitor for controlling voltage fluctuations in the constant voltage circuits within the CPU-IC 40.

89 and 90 are switches which are set due to the pulling out of the 3 o'clock crown 16, 91–93 are switches which are closed by the 2 o'clock button 63, the 10 o'clock button 62, and the 8 o'clock button 65 respectively. 94 and 96 are elements for the activation of a buzzer; 94 is a pressure increase coil, and 96 is a transistor equipped with a protective diode. 95 is a piezoelectric buzzer provided on the back cover of the watch case. The switches 91, 92, and 93 are push-button type switches, and are only activated when a button is pushed. Additionally, the switch 90 is composed so that the first coil (not shown) attached to the 3 o'clock crown moves it into contact with the electrode RA1 in the first setting, moves it into contact with the electrode RA2 in the second setting, and is left open in the normal setting. The switch 90 is composed so that the second coil (not shown) attached to the 4 o'clock crown moves it into contact with the electrode RB1 in the first setting, moves it into contact with the electrode RB2 in the second setting, and is left open in the normal setting.

Below, the actions of the present embodiment are explained. In the present embodiment, the character panel 30 is rotated in the opposite direction of the hour hand at the same speed as the hour hand (i.e. one complete rotation every 12 hours). Then, the P, V, and K on the display panel may be indicated by the "T" shaped mark on the bezel ring 25.

When changing the geographical region for which a time is to be displayed, the bezel ring 25 is rotated to the position in which the "T" mark points to the appropriate geographical region shown on the ting 26. The mount of rotation is measured by the encoder, and read into the CPU-IC 40. The CPU-IC 40 rotates the character panel 30 in the opposite direction to the rotation of the bezel ring 25 through the same angle of rotation as that of the bezel ring. As a result, tight after the rotation of the bezel ring 25, the Ayurveda time prior to rotation is maintained. After a set interval of time, the CPU-IC 40 rotates the character panel 30 in the same direction and through the same angle of rotation as the rotation of the above-mentioned bezel ting. In this way the display of the Ayurveda time according to the character panel 30 and the "T" mark gradually approaches the Ayurveda time of the geographical region set by the bezel ring.

Figure 13:
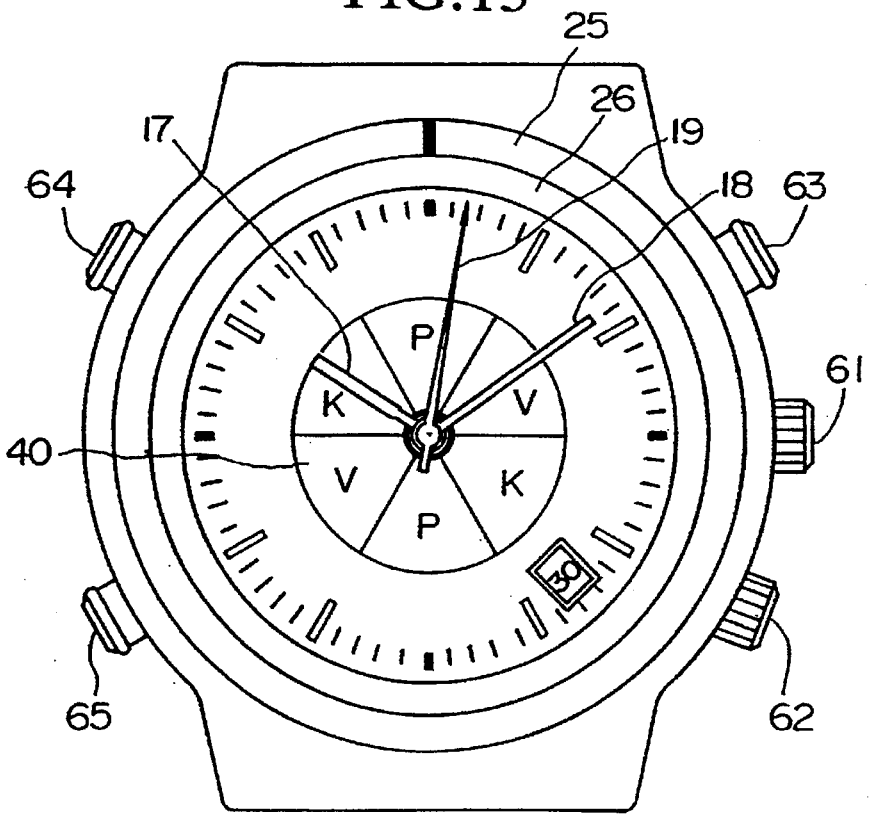

FIG. 13 is a modification of the present embodiment which uses a six-sectioned color separated character display 40 in place of the character display 30 of the above embodiment, and this display panel 40 completes a rotation once every 24 hours. Furthermore, the daytime P, V, and K are given different colors from the nighttime P, V, and K.

In the present embodiment, as well as in the fifth embodiment, when the set geographical region on the bezel ting is changed from the present region to a different region and then returned to the present region within a set interval of time, the above procedure in which "the display of the Ayurveda time according to the character panel 30 and the "T" mark gradually approaches the Ayurveda time of the geographical region set by the bezel ring" is not performed.

According to the present embodiment, it is possible to display both the daytime and nighttime P, V, and K.

Seventh Embodiment

Figure 16:
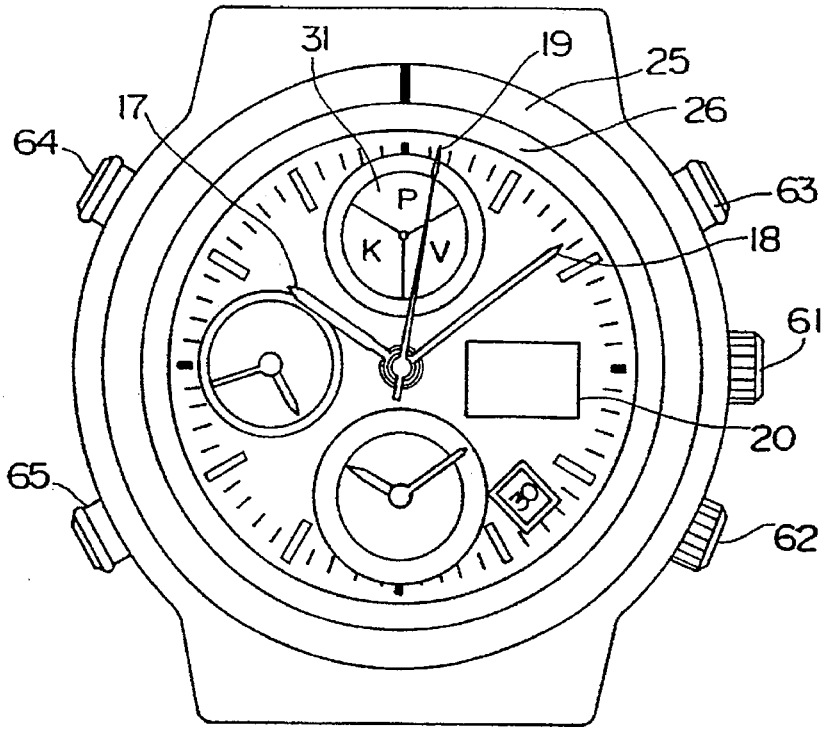
FIGS. 16 and 17 show the seventh embodiment of the present invention.
Figure 17:
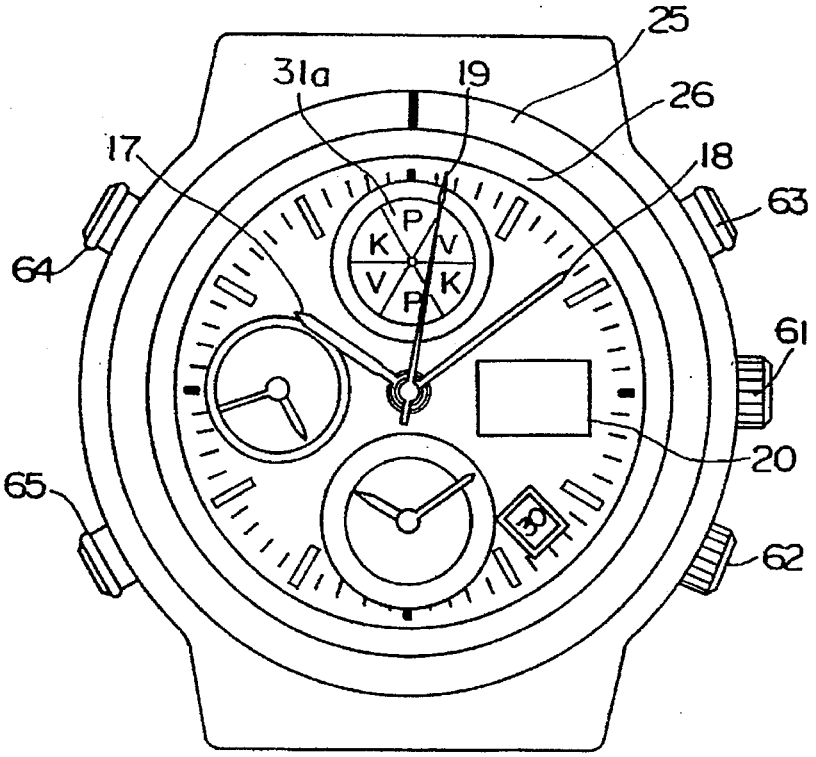

The seventh embodiment is shown in FIG. 16. The present embodiment attaches the character panel 31 to a different axis from that of the hour, minute, and second hands. This character panel 31 is rotated due to a motion conveyance system (not shown) composed of a step motor and gear sequence as has already been shown in FIG. 14. Additionally, FIG. 17 shows a modification example of the present embodiment. The character panel 31 in FIG. 16 is of three colors, and completes one rotation every 12 hours, whereas the character panel 31*a* of FIG. 17 is of six colors and completes one rotation every 24 hours.

Eighth Embodiment

Figure 18:
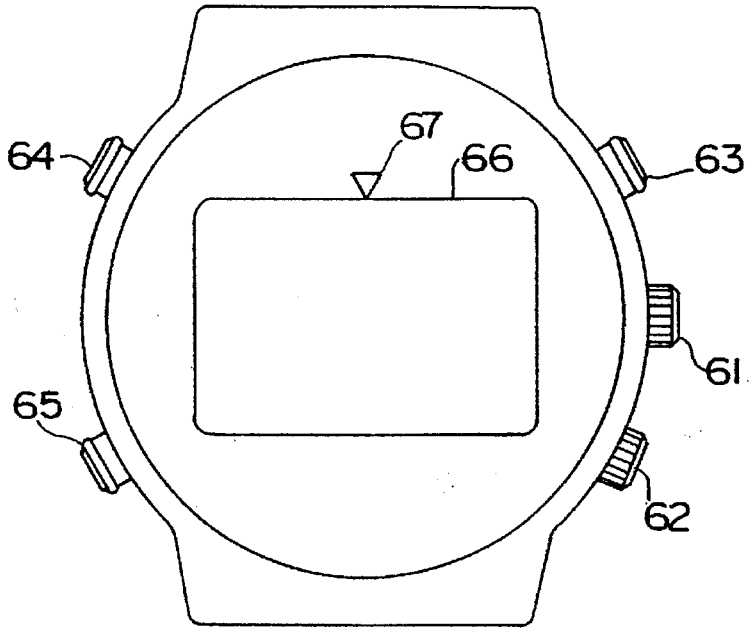
FIGS. 18, 19, 20A and 20B show the eighth embodiment of the present invention.

An outside view of the present embodiment is shown in FIG. 18. The present embodiment uses a liquid crystal display device 66 with a two layer structure in order to display the standard time and the Ayurveda time. A triangular mark 67 is provided above the liquid crystal display device, the mark being used to display the Ayurveda time.

The switching between a time display as a normal watch and a display of the Ayurveda time is done by pulling out the crown 61.

Figure 19:
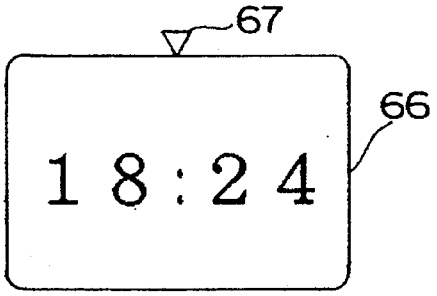
Figure 20A:
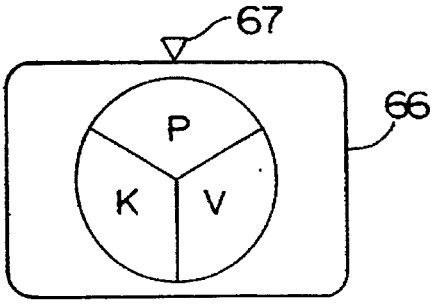
Figure 20B:
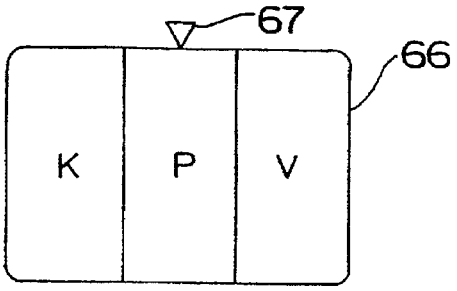

FIG. 19 shows the normal time display. When the crown 61 is pulled out, a circle separated into three colors corresponding to V, P, and K is displayed on the liquid crystal display device 66 as shown in FIG. 20(*a*). In the figure, the present Ayurveda time is P as indicated by the mark 67. The display of this circle rotates toward the left side of the drawing with the passage of time. In addition, an Ayurveda time display such as the one shown in FIG. 20(*b*) in which P, V, and K are separated by color into three zones on the liquid crystal display 66 is also possible. In the figure, the present Ayurveda time is P as indicated by the mark 67. The display of these zones moves toward the left side of the drawing with the passage of time.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

I claim:

1. A watch, comprising:

display means for displaying time and life rhythm of a living body which changes during a day, the life rhythm indicating a condition of the living body; and control means for dividing changes in the life rhythm during the day according to fixed time periods and for controlling said display means to display the life rhythm at present time;

wherein said control means includes dating means for outputting date information;

position information output means for outputting position information; and means for calculating a time of sunrise and a time of sundown based on said date information and said position information, determining three wedge shapes by separating into three equal sections a wedge shape between an hour hand position corresponding to the calculated time of sunrise and an hour hand position corresponding to the calculated time of sundown, and making a color-separated display on said display means corresponding to said three wedge shapes.

2. A watch, comprising:

display means for displaying time and life rhythm of a living body which changes during a day, the life rhythm indicating a condition of the living body; and control means for dividing changes in the life rhythm during the day according to fixed time periods and for controlling said display means to display the life rhythm at present time;

wherein said control means includes dating means for outputting date information;

geographical region setting means for setting a geographical region;

geographical region memory means for storing a latitude, a longitude, and a deviation from standard time separately for each region;

means for controlling said display means to display the time in the relevant geographical region based on the deviation from standard time of the geographical region set by said geographical region setting means; and means for calculating a time of sunrise and a time of sundown based on said date information and the above-mentioned latitude information, determining three wedge shapes by separating into three equal sections a wedge shape between an hour hand position corresponding to the calculated time of sunrise and an hour hand position corresponding to the calculated time of sundown, and making a color-separated display on said display means corresponding to said three wedge shapes.

* * * * *